US006315697B1

(12) United States Patent
Chen

(10) Patent No.: US 6,315,697 B1
(45) Date of Patent: Nov. 13, 2001

(54) STEPPING EXERCISER HAVING DEPTH ADJUSTABLE PEDALS

(76) Inventor: Tsung-Yu Chen, No. 23-4, Dingliau, Sanhe Tsuen, Shueishang Shiang, Chiai (TW)

( * ) Notice: Subject to any disclaimer, the term of this patent is extended or adjusted under 35 U.S.C. 154(b) by 0 days.

(21) Appl. No.: 09/684,974

(22) Filed: Oct. 10, 2000

(51) Int. Cl.[7] ..... A63B 22/14
(52) U.S. Cl. ..... 482/53; 482/146
(58) Field of Search ..... 482/51, 52, 53, 482/146, 147, 57

(56) References Cited

U.S. PATENT DOCUMENTS 5,230,675 * 7/1993 Lin ..... 482/53
5,453,065 * 9/1995 Lien et al. ..... 482/52
5,545,111 * 8/1996 Wang et al. ..... 482/53
5,628,709 * 5/1997 Chen ..... 482/53

* cited by examiner

*Primary Examiner*—Stephen R. Crow
(74) *Attorney, Agent, or Firm*—Rosenberg, Klein & Lee

(57) ABSTRACT

A stepping exerciser includes a rotatable member received in a tubular member which is located on a base. Two slots are defined diametrically through the tubular member and two extensions extending from the rotatable member extend through the slots. Two pedals each are pivotally connected to respective one of two arms extending from the tubular member and two pushing rods extend from the two pedals. Each pushing rod has a block which contacts the extension of the rotatable member. Each pedal has a cylinder connected thereto and the other end of the cylinder is connected to the base. The blocks each have a plurality of convex portions so as to adjust a distance between the pushing rod and the extension and to adjust the stroke of the cylinders.

3 Claims, 5 Drawing Sheets

STEPPING EXERCISER HAVING DEPTH ADJUSTABLE PEDALS

FIELD OF THE INVENTION

The present invention relates to a stepping exerciser having two pedals connected to two respective cylinders and the depth being stepped of each pedal can be adjustable.

BACKGROUND OF THE INVENTION

The stepping exerciser known to applicant is US patent application with application Ser. No. 09/431,203. The stepping exerciser is illustrated in FIGS. 1 to 3 and includes a base 4 with a tubular member 42 connected thereto and two couplers 54 extend in opposite directions from the tubular member 42 so that two pedals 52 are respectively and rotatably connected to the two couplers 54. The two couplers 54 are rotatable about a central axis of a shaft 422 on which the couplers 54 are mounted. Two slots 421 are defined through the tubular member 42. A rotatable member 51 is received in the tubular member 42 and two extension members 511 extend from the rotatable member 51 and extend through the slots 421. Each of the extension members 511 has a sleeve 512 mounted thereon. Two connection rods 41 connected to the tubular member 42 so that two cylinders 53 are respectively connected to an underside of each of the pedals 52 and the two connection rods 41. When a user steps on the two pedals 52 and alternatively steps the pedals 52, the couplers 54 are rotated and the two extension members 511 are pushed by the pushing rods 541 extending from the couplers 54. By this way, the user can alternatively steps the pedals 52 downward and the cylinders 53 provide resistance for the exercising purpose.

However, because the two feet of users have different level of muscle forces so that the resistance may be too solid for one of the two feet. Therefore, the user feels that his/her body is inclined to one side because the foot on that side can step deeper than the other foot.

The present invention intends to provide a stepping exerciser wherein the depth of the pedals can be adjustable.

SUMMARY OF THE INVENTION

In accordance with one aspect of the present invention, there is provided a stepping exerciser and comprising a base with two rods connected to the base. A tubular member extends from the base and two slots are defined diametrically through the tubular member. Two arms extend diametrically from the tubular member. A rotatable member is rotatably received in the tubular member and two extensions extend diametrically from the rotatable member. The two extensions extend through the two slots. Two pedals each have a sleeve which is mounted to respective one of the two arms and each sleeve has a pushing rod extending radially therefrom. Two blocks are respectively connected to the two pushing rods and contact the two extensions. Each block has a plurality of convex portions extending radially outward therefrom. Two cylinders are respectively connected between respective one of the two pedals and respective one of the two rods.

The primary object of the present invention is to provide a stepping exerciser wherein the depth of each pedal that is stepped downward can be adjusted independently.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
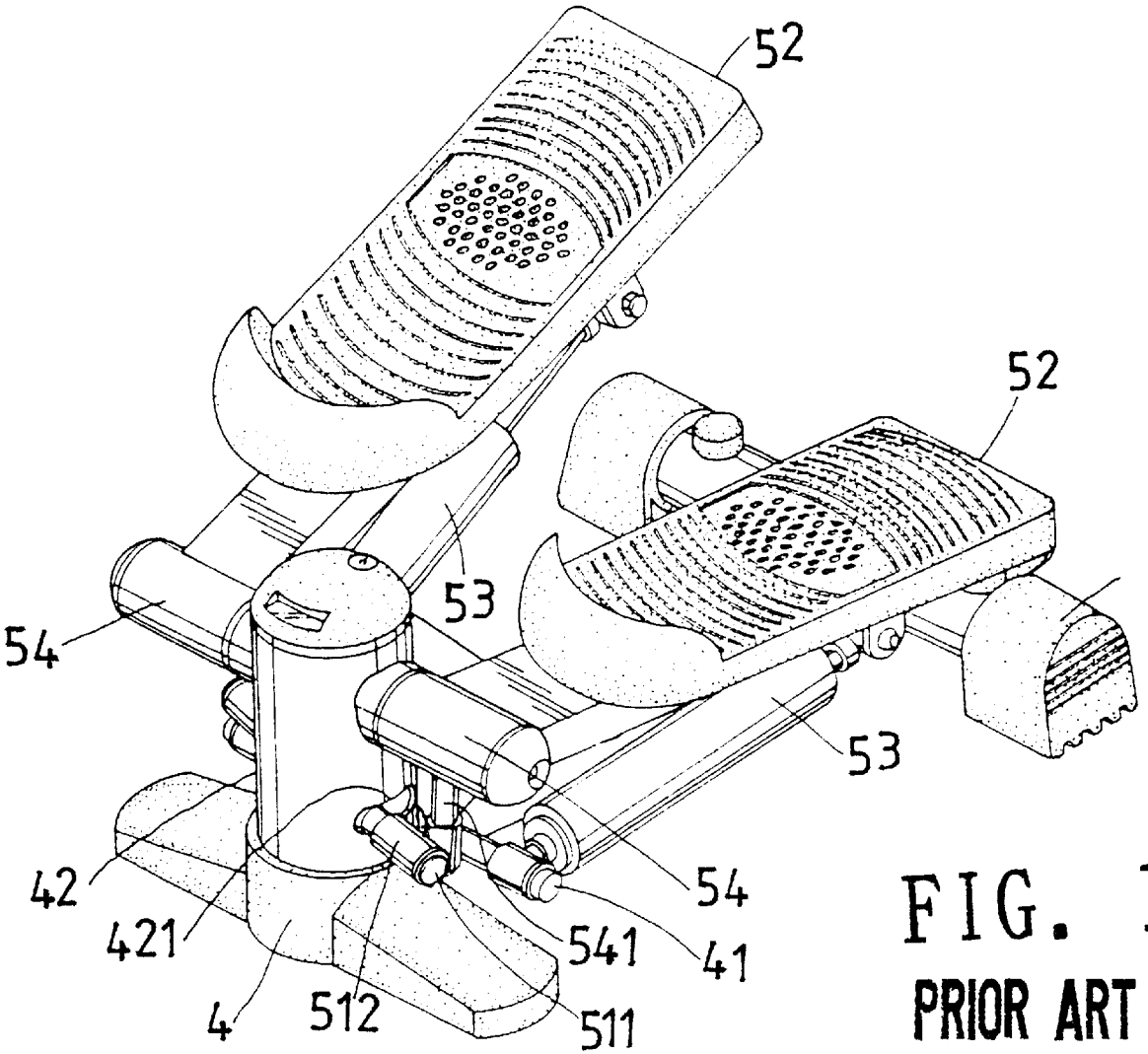
FIG. 1 PRIOR ART
FIG. 1 is a perspective view to show a conventional stepping exerciser.
Figure 2:
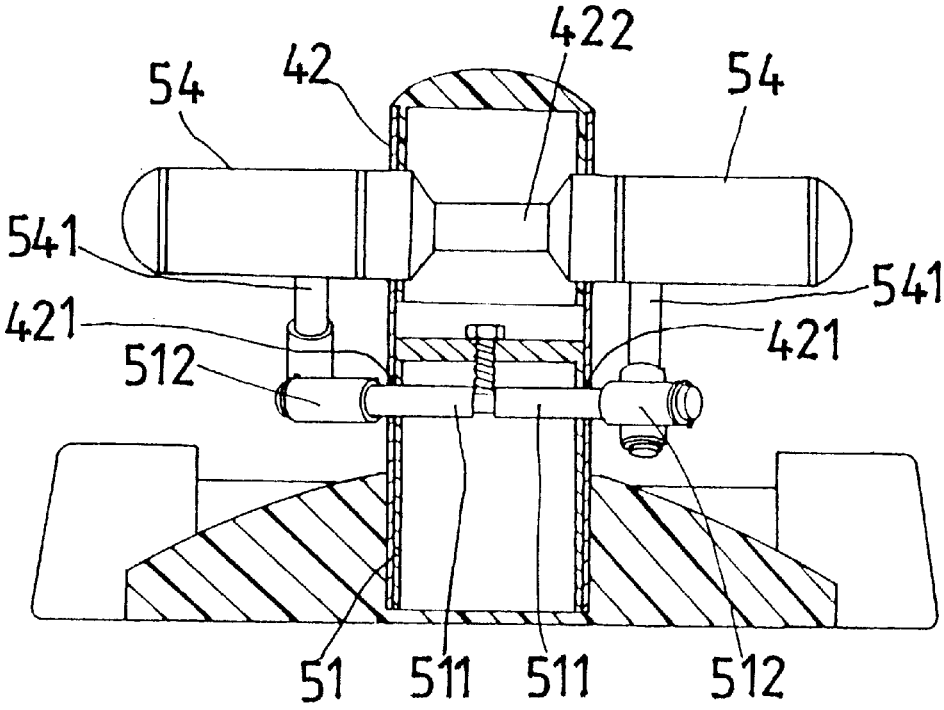
FIG. 2 PRIOR ART
FIG. 2 is a cross sectional view to show the mechanism of the conventional stepping exerciser.
Figure 3:
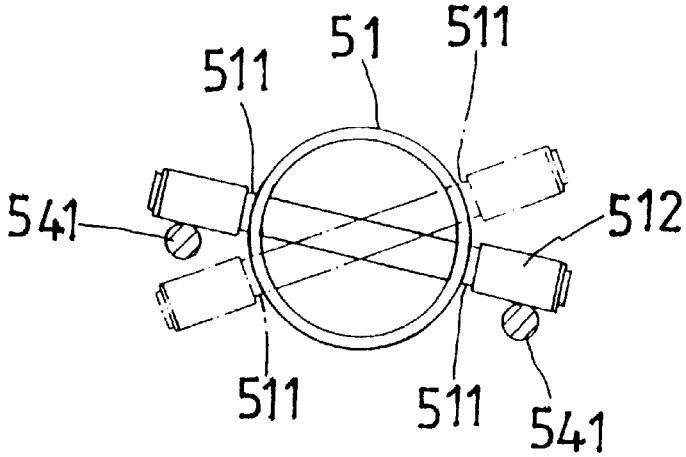
FIG. 3 PRIOR ART
FIG. 3 is an illustrative view to show two extensions of the rotatable member is rotated by two pushing rods of the conventional stepping exerciser.
Figure 4:
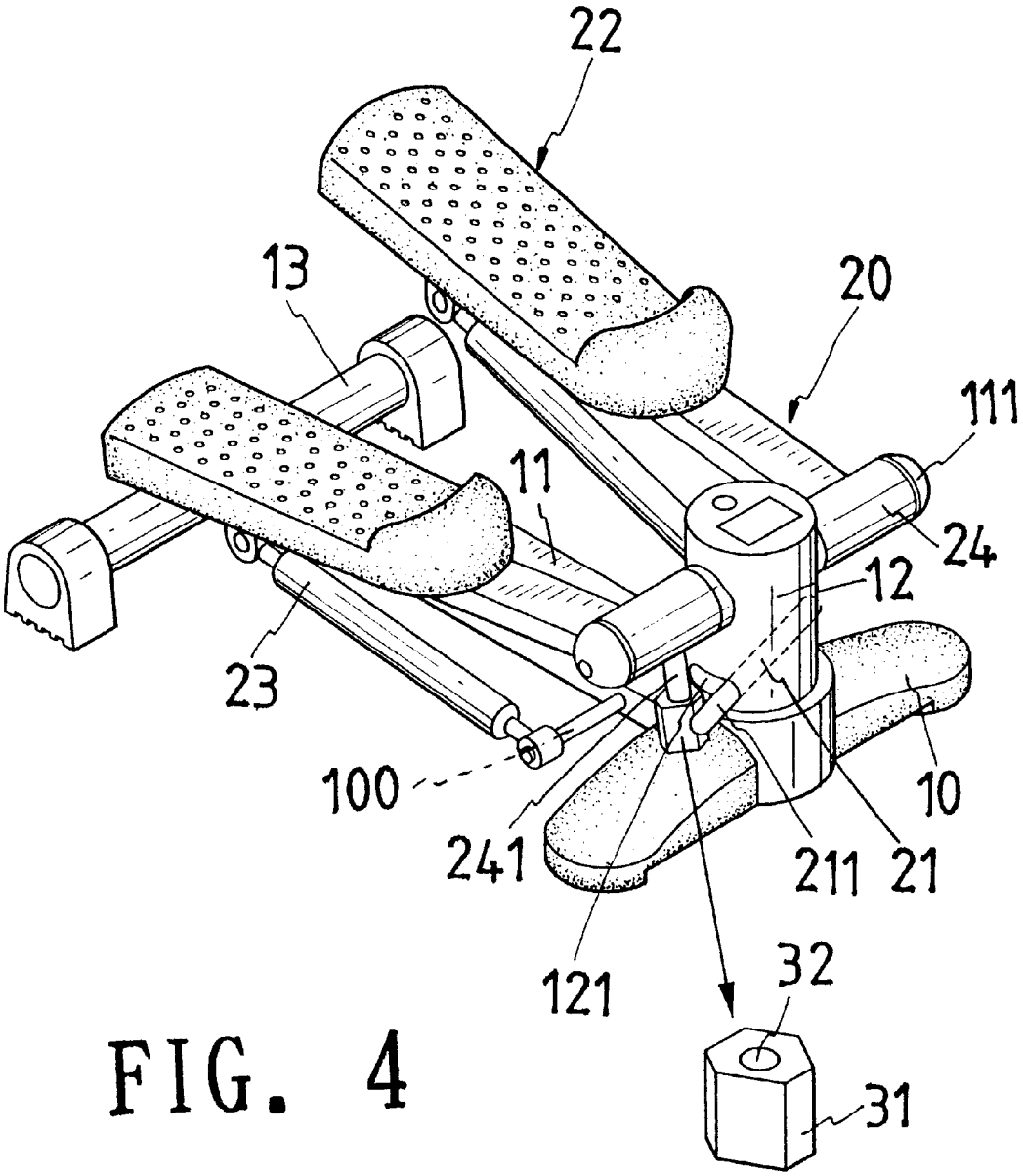
FIG. 4 is a perspective view to show a stepping exerciser of the present invention and a block on each of the pushing rods of the stepping exerciser.
Figure 7:
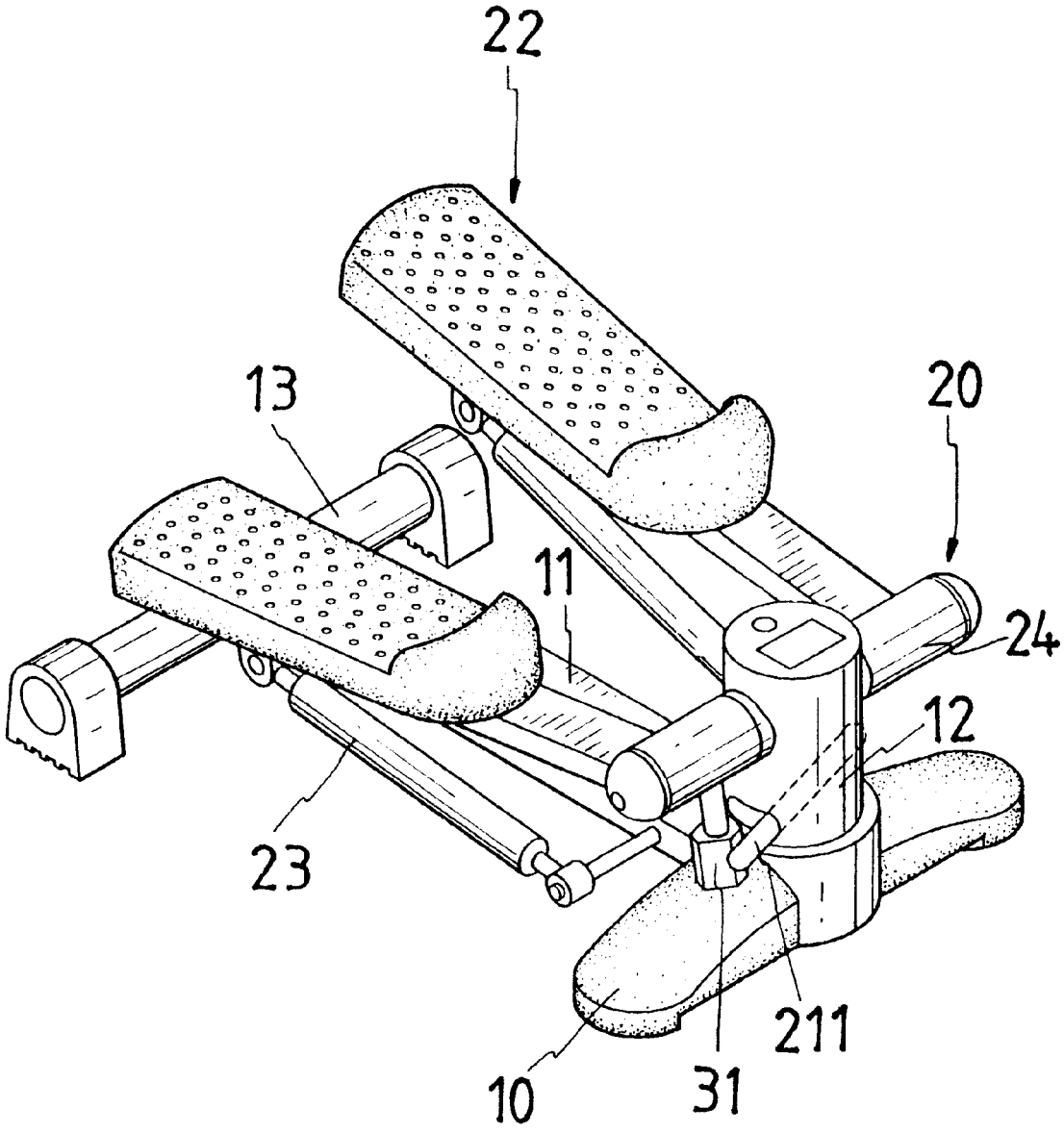
FIG. 7 is a perspective view to show the stepping exerciser of the present invention.

Referring to FIGS. 4 and 7, the stepping exerciser of the present invention comprises an H-shaped base including two transverse bars 10, 13 connected by a central rod 11. Two rods 100 are connected to two sides of the central rod 11 of the base. A tubular member 12 extends from a front transverse bar 10 of the base and two slots 121 are defined diametrically through the tubular member 12. Two arms 111 extend diametrically from the tubular member 12. A rotatable member 21 is rotatably received in the tubular member 12 and two extensions 211 extend diametrically from the rotatable member 21. The two extensions 211 extend through the two slots 121 and can be moved within the range of the slots 121.

Two pedals 22 each have a sleeve 24 connected to a front end thereof and the sleeves 24 are respectively mounted to the two arms 111. Each sleeve 24 has a pushing rod 241 extending radially therefrom and two blocks 31 are respectively connected to the two pushing rods 241. The two blocks contact the two extensions 211 of the rotatable member 21. Each block 31 has a polygonal cross section and includes a plurality of convex portions extending radially outward therefrom. Each of the blocks 31 has an eccentric passage 32 defined longitudinally therethrough so as to receive the pushing rod 241.

Two cylinders 23 respectively connected between an underside of a rear end of respective one of the two pedals 22 and respective one of the two rods 100.

Figure 5:
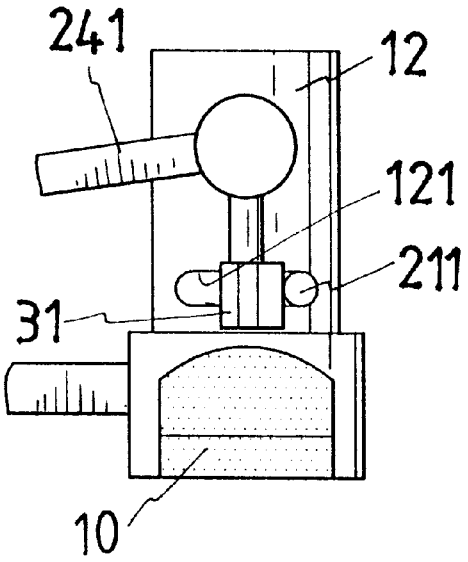
FIG. 5 is an illustrative view to show a longer distance is adjusted between the extension and the pushing rod of the stepping exerciser.
Figure 6:
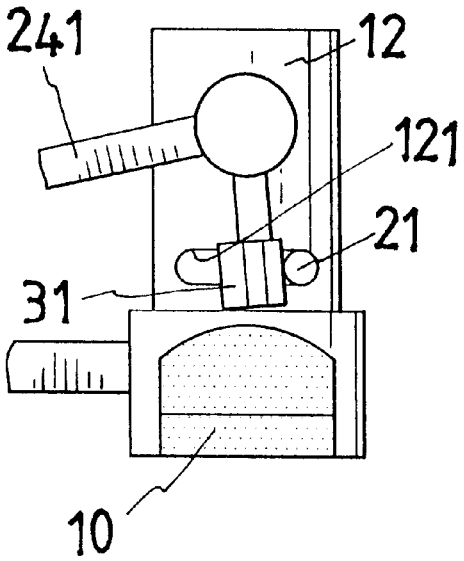
FIG. 6 is an illustrative view to show a shorter distance is adjusted between the extension and the pushing rod of the stepping exerciser.

As shown in FIGS. 5 and 6, the blocks 31 can be mounted to the pushing rods 241 to let different convex positions contact the extensions 211. When a longer distance is adjusted between the extension 211 and the pushing rod 241 as shown in FIG. 5, only a smaller depth can be stepped for the pedal 22. On the contrary, when a shorter distance is adjusted between the extension 211 and the pushing rod 241 as shown in FIG. 6, the pedal 22 can be stepped downward a deep depth. By this way, the foot having less muscle force may step less deeper than the foot having strong muscle force.

While we have shown and described various embodiments in accordance with the present invention, it should be clear to those skilled in the art that further embodiments may be made without departing from the scope and spirit of the present invention.

What is claimed is:

1. A stepping exerciser comprising:

a base and two rods connected to said base, a tubular member extending from said base and two slots defined diametrically through said tubular member, two arms extending diametrically from said tubular member;

a rotatable member rotatably received in said tubular member and two extensions extending diametrically from said rotatable member, said two extensions extending through said two slots;

two pedals each having a sleeve which is mounted to respective one of said two arms, and each sleeve having a pushing rod extending radially therefrom, two blocks respectively connected to said two pushing rods and contacting said two extensions, each block having a plurality of convex portions extending radially outward therefrom, and two cylinders respectively connected between respective one of said two pedals and respective one of said two rods.

2. The stepping exerciser as claimed in claim 1, wherein each of said blocks has an eccentric passage defined longitudinally therethrough so as to receive said pushing rod.

3. The stepping exerciser as claimed in claim 2, wherein each of said blocks has a polygonal cross section.

* * * * *